United States Patent [19]

Wedeniwski

[11] Patent Number: 4,747,236

[45] Date of Patent: May 31, 1988

[54] METHOD FOR WORKING, BY METAL-CUTTING PROCESSES, THE SURFACES OF PROFILES HAVING A NON-CIRCULAR CONTOUR, IN PARTICULAR CAMSHAFTS

[75] Inventor: Horst J. Wedeniwski, Remshalden-Grunbach, Fed. Rep. of Germany

[73] Assignee: Fortuna-Werke Maschinenfabrik GmbH, Stuttgart, Fed. Rep. of Germany

[21] Appl. No.: 896,520

[22] Filed: Aug. 13, 1986

[30] Foreign Application Priority Data

Aug. 14, 1985 [DE] Fed. Rep. of Germany ..... 3529099

[51] Int. Cl.[4] ..... B24B 19/12

[52] U.S. Cl. ..... 51/281 C; 51/105 EC; 51/165.77; 82/18; 409/104; 409/132

[58] Field of Search ..... 51/97 NC, 105 EC, 101 R, 51/165.71, 165 R, 165.77, 165.8, 165.9, 281 R, 281 C; 82/18; 409/104, 111, 112, 122, 123, 131, 132

[56] References Cited

U.S. PATENT DOCUMENTS

| | | | |
|---|---|---|---|
| 3,482,357 | 12/1969 | Inaba et al. | 51/165 R X |
| 4,443,976 | 4/1984 | Kaiser, Jr. | 51/101 R X |
| 4,528,781 | 7/1985 | Koide et al. | 51/281 C |
| 4,557,076 | 12/1985 | Helbrecht | 51/165.71 |
| 4,621,463 | 11/1986 | Komatsu et al. | 51/281 C |

FOREIGN PATENT DOCUMENTS

| | | |
|---|---|---|
| 2621430 | 5/1976 | Fed. Rep. of Germany . |
| 2821753 | 5/1978 | Fed. Rep. of Germany . |

OTHER PUBLICATIONS

"Oberfiache und Jot" 1978, vol. 10, pp. 634–641.

wt-Zeitschrift für Industrielle Fertigung 69, from G. Werner "Technologische und Konstruktive Voraussetzungen für das Tiefschleifen, 1979 pp. 613–620.

*Primary Examiner*—Robert P. Olszewski

*Attorney, Agent, or Firm*—Kokjer, Kircher, Bradley, Wharton, Bowman & Johnson

[57] ABSTRACT

A method serves for working, by metal-cutting processes, a surface of profiles having a non-circular contour, in particular for grinding camshafts. Starting out from a blank contour (30-1-32), material is removed from the surface to give the profile a desire contour (**30*a*, 31*a*, 32*a*) by moving the processing tool and the profile relative to each other in such a manner that the portion of the processing tool which is at any time in engagement with the surface is moved along the contour in a path-controlled manner, while on the other hand the tool is advanced in feed-controlled manner by the surface distance between the blank contour (30,31,32) and the desired contour (30*a*,31*a*,32*a*). In order to reduce the processing time and to improve the processing quality, the active portion is removed initially in feed-controlled operation from a first point (40) on the surface of the blank contour (30,31,32) to a second point (42) of the desired amount (30*a*,31*a*,32*a*), and then moved in path-controlled operation along the desired contour (30*a*,31*a*,32*a***).

4 Claims, 2 Drawing Sheets

METHOD FOR WORKING, BY METAL-CUTTING PROCESSES, THE SURFACES OF PROFILES HAVING A NON-CIRCULAR CONTOUR, IN PARTICULAR CAMSHAFTS

BACKGROUND OF THE INVENTION

The present invention relates to a method and a device for working, by metal-cutting processes, the surfaces of profiles having a non-circular contour, in which, starting out from a blank contour, material is removed from the surface to give the profile a desired contour by moving the processing tool and the profile relative to each other in such a manner that the portion of the processing tool which is at any time in engagement with the surface is moved along the contour in a path-controlled manner, while on the other hand the tool is advanced in feed-controlled manner by the surface distance between the blank contour and the desired contour.

Methods of this type have previously been known and are used, for example, for grinding the cams of camshafts.

In the case of the known method, the camshaft is arranged to rotate about a fixed axis, and a grinding wheel is seated to rotate about an axis extending in parallel to the camshaft axis. In order to obtain a predetermined desired contour of the cams, the distance between the axis of the grinding wheel and the camshaft axis is varied while the camshaft rotates slowly so that the surface section of the grinding wheel which is at any time in engagement with the workpiece removes so much material from the surface of the cam that finally the desired contour is obtained.

The variation of the distance between the axis of the grinding wheel and the camshaft axis is dependent upon two marginal conditions:

On the one hand, the distance has to be varied in order to allow for the particular contour of each cam to be processed. This component of the entire variation of the distance is called "path-controlled operation".

On the other hand, however, one also has to vary the distance of the axes in order to ensure a certain infeed, i.e. an advancing motion of the tool towards the cam to be processed by the difference between the blank dimension and the desired dimension. This component of the variation of the distance is called "feed-controlled operation".

SUMMARY OF THE INVENTION

In the case of the known methods, which normally use numerically controlled processing machines, both the path-controlled operation and the feed-controlled operation are carried out simultaneously.

According to one of the known methods, this is achieved by interpolating continuously, as a function of the rotation of the camshaft, the next point to be approached and by superimposing numerically, for the purposes of this interpolation, the path-controlled movement and the feed-controlled movement.

According to another known method, the grinding wheel is mounted on a two-part slide with one part of the slide being arranged to be moved along the other part, the two parts being controlled according to the path-controlled movement and the feed-controlled movement, respectively. Thus, according to this method, the required superimposition is achieved by mechanical superposition.

It is, therefore, a common feature of the two known methods just described that the point of the surface area of the grinding wheel which is at any time in engagement with the workpiece moves between the blank contour and the desired contour along a path having the shape of a multiple spiral. Given the continuous feeding motion, this movement must always have a radial component and must, as mentioned before, be adjusted by continuous superimposition of the path-controlled movement and the feed-controlled movement.

Accordingly, both known methods have the following essential drawbacks:

On the one hand, the continuous superimposition of the path-controlled movement and feed-controlled movement requires a considerable input. For, if the superimposition is to be achieved by interpolation of the next processing point to be approached, it is necessary to use a very quick and, thus, expensive computer unit; if a simpler computer unit is used, the processing time will drastically increase because the computing time necessary for determining the next point to be approached will become unacceptably long.

In the case of the mechanical superimposition described in connection with the second known method mentioned before, considerable mechanical problems are encountered, in particular because there may be circular sections, in particular when processing cam contours, during which the control value of the path-controlled movement remains constant. The component of the feeding motion reserved for the path-controlled movement therefore must not change as long as this circular section is processed, a requirement which hardly can be fulfilled considering the degree of precision with which the processing operation has to be carried out in the cases under discussion. In practice, when the control input for the path-controlled feeding motion is to be kept within reasonable limits, vibratory motions will be encountered which are caused by small regulating cycles about a constant position.

Finally, the known methods exhibit the common disadvantage that due to the continuous feeding motion, there is always a radial component in the processing direction which may either lead to problems regarding the surface quality or else require an additional, secondary treatment.

Now, it is the object of the present invention to improve a method of the type described before in such a manner that the desired contours can be obtained without sacrifice as to accuracy at considerably lower cost and at high processing speed.

This object is achieved according to the invention by a method in which the active portion is moved initially only in feed-controlled operation from the first point on the surface of the blank contour to a second point of the desired contour, and then moved only in path-controlled operation along the desired contour.

In this manner, the object of the invention is solved completely and perfectly.

By separating the feed-controlled movement and the path-controlled movement strictly into two processing steps following each other in time it is ensured that the position control has to operate only under one aspect so that the disadvantages described before, which are the result of the simultaneous operation, can be avoided.

Consequently, when a numerical control is used, it has to interpolate one of the movements only during any one of the two phases following each other in time, and this decreases the computing time and/or reduces the demands to be placed upon the necessary computer unit. On the other hand, when the mechanical superimposition method is used, the one feeding part may be mechanically locked in a controlled manner while the other feeding part is active so that no errors will occur in this respect.

The method according to the invention is, therefore, fundamentally independent from the manner in which the profile and the processing tool are arranged or moved relative to each other, and also from the type of profile to be processed at any time, and the type of the processing tool to be used.

According to a preferred embodiment of the invention, the processing tool is arranged to rotate about the first axis.

Although it is of course also possible in principle to use stationary tools, such as an electrical discharge machining device, a laser or the like, tools which are rotatable about a first axis are preferred because this permits the use of proven tools of the type normally used, in particular, in metal processing.

According to a further preferred embodiment of the invention, the profile is arranged to rotate about a second axis although in principle stationary profiles can be processed, too. However, when the profile is rotatable about a second axis, this offers the advantage that defined conditions can be adjusted in a very simple manner because the processing points to be approached at any time can be determined easily as a function of the rotary angle of the second axis in the manner known as such.

According to still another preferred embodiment of the invention, the first axis extends in parallel to the second axis, and the distance between the two axes can be adjusted in the direction of a third axis extending perpendicularly thereto, the second axis being substantially stationary.

This feature provides the particular advantage that for the path-controlled operation and the feed-controlled operation only the first axis has to be adjusted in the direction of the third axis, as a function of the rotary angle of the profile.

Another particularly preferred embodiment of the invention is characterized in that the first point and the second point define a rotary angle of the second axis being smaller than 180° and preferably in the range between 20° and 180°.

This feature provides the advantage that the desired contour can be approached over a relatively small circumferential area exclusively in the feeding operation—when a grinding wheel is used, by so-called deep-grinding—so that the greatest part of the contour is then exclusively processed to the desired dimension in path-controlled operation.

A particularly good effect is further achieved when the processing tool is advanced continuously in the feeding operation.

The locus of the respective processing point then exhibits the shape of an Archimedean spiral, a shape which is easy to handle in numerical control for control functions.

According to a still other preferred embodiment of the invention, the active portion, after having moved along the desired contour, is moved from a third point of the desired contour initially only in the feeding operation to a fourth point of a second desired contour and then, in path-controlled operation, along the said second desired contour.

This feature, which provides that the steps according to the invention can be carried out several times in series, provides the advantage that the intended effect can be achieved also where large material volumes are to be removed. This may be the case when the blank contour is very irregular so that the required desired contour cannot be obtained by a single processing operation for technical reasons. However, contrary to the prior art, the point of the processing tool being in engagement with the workpiece at any given time is again not moved along a path having the shape of a multiple spiral; rather, the feeding area is always limited to a very narrow surface area while otherwise the full operation is again carried out in path-controlled operation. The locus of the processing point therefore has the shape of several concentric loci extending at a certain distance parallel to each other, except for the small feeding area.

As mentioned before, a preferred application of the invention, which is however not intended to limit the invention, is seen in the processing of cams. It is particularly preferred that the cams used have at least one circular section and that the feeding operation takes place in the area of the circular section.

This feature provides the special advantage that it is particularly easy to dispense with the path-controlled operation in the area of the circular section because within the latter the surface has a constant radius relative to the axis of rotation of the profile.

In a preferred improvement of this embodiment of the invention, the circular section constitutes the base circle of the cam which provides the advantage that the circumference of the base circle is particularly long so that, depending on the particular requirements, the feed-controlled operation can take place over large peripheral areas.

Other advantages of the invention will become apparent from the following specification in conjunction with the attached drawing.

It goes without saying that the features which have been described before and which will be explained hereafter, can be used not only in the specified combination, but also in any other desired combination or individually, without departing from the scope of the present invention.

DESCRIPTION OF THE DRAWINGS

Certain embodiments of the invention will be described hereafter with reference to the drawing in which.

DETAILED DESCRIPTION OF THE INVENTION

Figure 1:
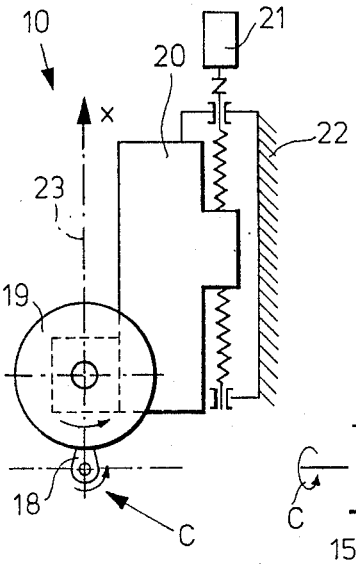
FIGS. 1 and 2 show two representations of a device for carrying out the method of the invention, viewed in two directions perpendicular to each other.
Figure 2:
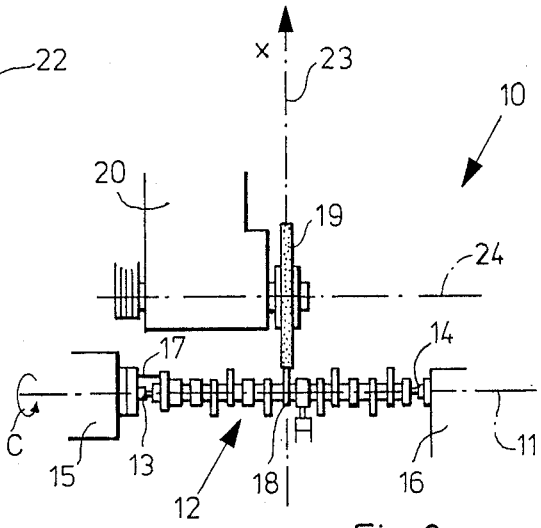

In FIGS. 1 and 2, reference numeral 10 designates a grinding machine of the type used for carrying out the method according to the invention.

A camshaft 12 is arranged to rotate about a fixed axis 11 often called the C axis in the art. The camshaft 12 is held to this end between two centers 13 and 14 of a headstock 15 and a tailstock 16, and the camshaft 16 is driven via a connection 17, which is fixed against rotation, between the camshaft 12 and a spindle of the headstock 15.

In the operating position shown in FIGS. 1 and 2, the grinding wheel 19 just works a camshaft 18 of the camshaft 12. The grinding wheel 19 is operated by a drive 20 which can be displaced by means of a feed unit 21 relative to a fixed base 22, along an axis 23, usually called the X axis in the art. The grinding wheel 19 itself can rotate about an axis 24 so that the distance between the axes 11 and 24 can be adjusted by the feed unit 21 in the direction of the axis 23 extending perpendicularly thereto.

In FIGS. 1 and 2, the control and regulating units for deriving from the respective rotary position of the camshaft 12 control signals for the feed unit 21 are not shown for clarity's sake.

Figures 3, 4:
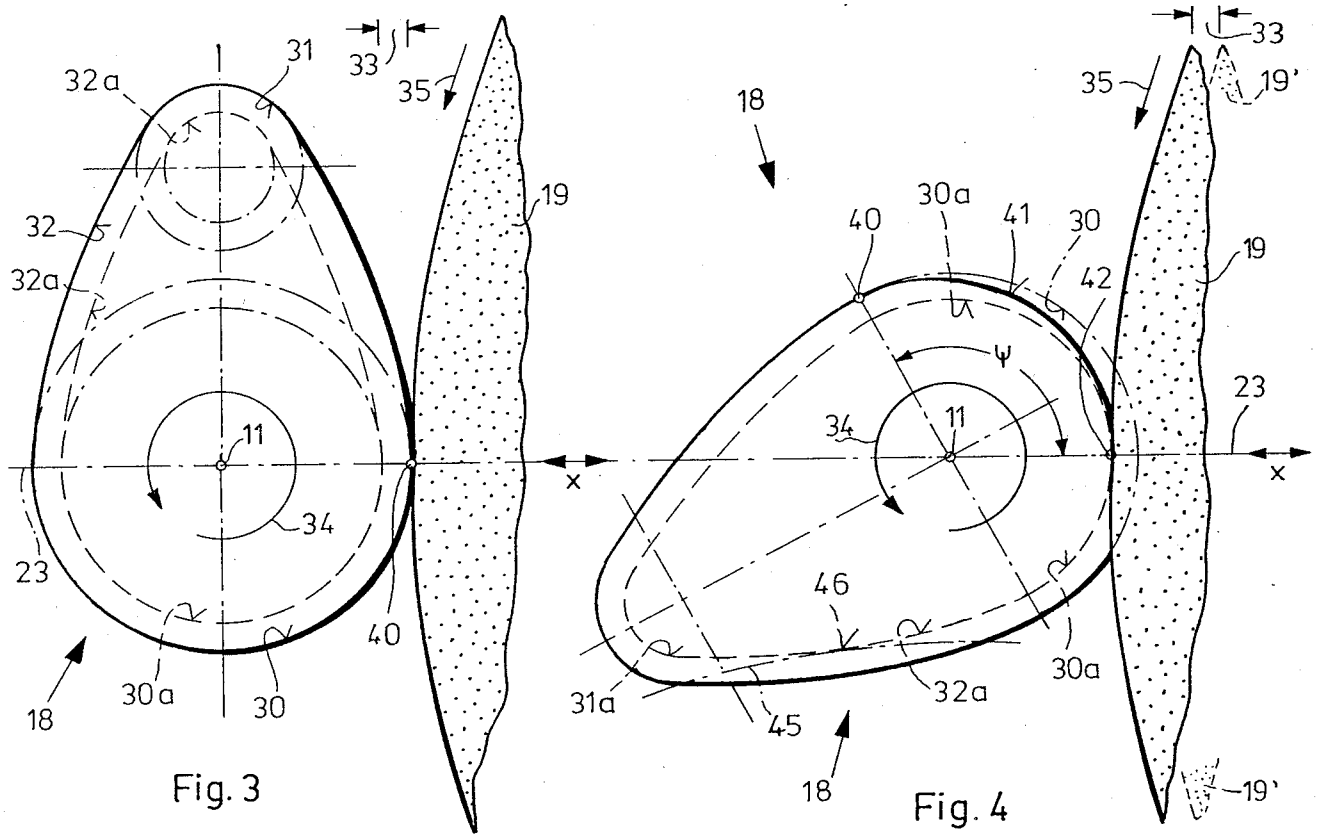
FIGS. 3 and 4 show a greatly enlarged detail of the device shown in FIGS. 1 and 2, illustrating two processing steps of the method of the invention.

FIGS. 3 and 4 show the conditions existing during working of the cam 18 by the grinding wheel 19 in a greatly enlarged view rotated by approx. 90° in clockwise sense relative to the view of FIG. 1.

FIG. 3 shows the initial position of the cam 18. The cam 18 has an outer contour which comprises a base circle 30 and a secondary circle 31, the two circles being interconnected via straight or curved flanks 32. The sections 30, 31, 32 shown in thick full lines in FIG. 3 define a blank contour, i.e. the contour of a cam in the unfinished condition, while reference numerals **30*a*, 31*a*, 32*a* designate the corresponding elements of a desired contour which is to be produced by means of the method of the invention. In order to obtain this desired contour, an overall feed motion 33 corresponding to the distance between the contour 30/31/32 and the contour 30*a*/31*a*/32*a*** is required.

Arrow 34 indicates the sense of rotation of the cam 18, arrow 35 the sense of rotation of the grinding wheel 19. FIG. 3 shows the cam 18 in its initial position. The grinding wheel 19 has been moved into contact with the cam 18. In this initial position, the rotary position of the cam 18 is adjusted in such a manner that the cam 18 and the grinding wheel 19 are in contact with each other at a first point 40 located in the area of transition between the flank 32 and the base circle 30.

In a first procedural step, the cam 18 is now rotated in the direction indicated by arrow 24, and the grinding wheel 19 is displaced simultaneously to the left, along the axis 23. When the angular speed of the cam 18 and the feeding speed of the grinding wheel 19 are properly adjusted, one thereby obtains the curve 41 shown in FIG. 4 between the first point 40 on the blank contour and a second point 42 on the desired contour which is reached within a rotary angle of, for example, 120°. Given the linear feeding motion of the grinding wheel 19, the said locus 41 has the shape of an Archimedean spiral.

Accordingly, the grinding wheel 19 has been displaced in linearly controlled manner from the position 19' shown in broken lines into the position 19 shown in full lines.

After the second point 42 has been reached, a second procedural step is initiated.

During this second procedural step, the variation of the position of the grinding wheel 19 in the direction of the X axis 23 is adjusted in such a manner that the point of the surface of the grinding wheel 19 which is at any time in engagement with the workpiece follows exactly the desired contour **30*a*/31*a*/32*a***.

This leads among other things to the effect that the material is removed during this procedural step always tangentially relative to the desired contour **30*a*/31*a*/32*a*. This is illustrated in FIG. 1 by means of the position 45 of the grinding wheel 19 relative to the cam 18, and it can be seen clearly that in this position 45 the grinding wheel 19 is in contact with only one point 46 of the desired contour, in this case at the flank 32*a***.

Figure 5:
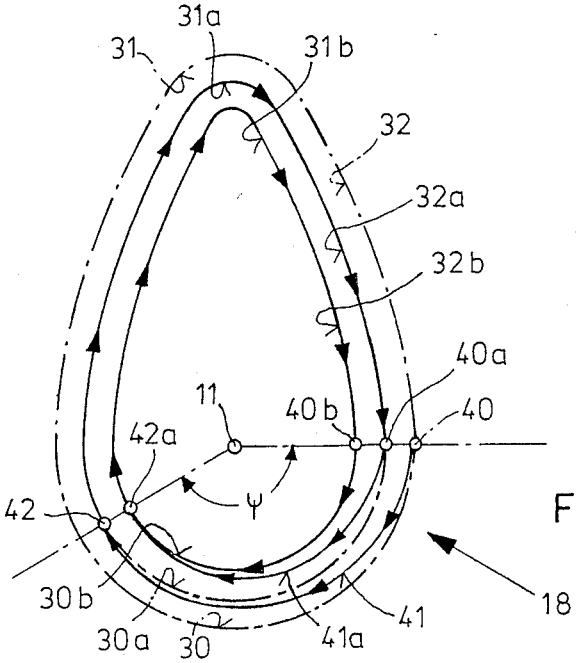
FIG. 5 is a diagrammatic representation of a locus of a processing point when the profile is processed in multiple layers.

Finally, FIG. 5 shows a variant in which the before-described sequence of the two procedural steps is repeated cyclically.

The curve of the path of the respective processing point which in FIG. 5 is shown in a thick full line, commences again at the first point 40, extends thereafter in the described manner during the feeding operation along the curve 51 until it reaches the second point 42 where the path-controlled operation commences so that the path now extends along the desired contour **30*a*/31*a*/32*a* as described before. The path-controlled operation then continuous up to the third point 40*a* which is located radially beside the first point 40. When the third point 40*a* is reached, the process changes over again to mere feed-controlled operation, and the curve of the respective processing point extends again along a locus 41*a* situated inside of the locus 41 described before. Now, the mere feed-controlled operation is continued until a fourth point 42*a* located radially beside the second point 42 is reached, when the method changes over again to mere path-controlled operation so that a further desired contour 30*b*/31*b*/32*b* is obtained. This further desired contour is continued via a fifth point 40*b* situated radially beside the first point 40 and the third point 40*a* so that the further desired contour 30*b*/31*b*/32*b* is followed up to the fourth point 40*a* and the desired further contour 30*b*/31*b*/32*b*** is now fully worked.

In a practical example of the method according to the invention, a four-cylinder camshaft whose cams had a base circle of 38 mm diameter and a cam pitch of approx 10 mm, was worked at a circumferential speed of the grinding wheel 19 of 45 m/s. The radial overmeasure was between 2 and 2.5 mm.

For rough grinding, the cam was rotated a total of four times, and the before-described feed-controlled and path-controlled operations were carried out alternately in the explained manner, followed finally by one rotation in pure path-controlled operation. During the subsequent finish-grinding operation, three rotations with alternate feed-controlled and path-controlled operation were carried out, followed by five rotations without feed-controlled operation.

The relation between feeding speed and angular speed of the cam was selected in such a manner that the angle adjusted was 30° for rough grinding and 60° for finish-grinding.

In this manner, a reduction of the total grinding time per cam to less than half the time required by the conventional method could be achieved.

I claim:

1. A method of metal cutting a cam blank to produce a cam having a circumferential cam profile which includes a base circle, said method comprising the steps of:

applying a metal cutting tool to the blank at a point thereon located radially outwardly from the base circle of said cam profile;

rotating the blank through an arc no greater than 180° while simultaneously effecting a feed mode of operation in which the tool and blank are fed toward one another until the tool reaches a point on the base circle which is offset by no more than 180° from the point at which the tool is applied to the blank; and thereafter rotating the cam through an angle of substantially 360° while simultaneously effecting a path controlled mode of operation in which the tool is maintained on said circumferential cam profile to remove all material on the blank outwardly of said cam profile.

2. The method of claim 1, wherein said arc is in the range of 20°–180°.

3. A method for grinding a cam blank having a circumferential surface to form a cam having a circumferential cam profile which includes a base circle centered on a camshaft, said method comprising the steps of:

bringing a grinding wheel into contact with a point on said surface of the cam blank located radially outwardly of the base circle;

rotating the camshaft and grinding wheel simultaneously while effecting a feed controlled operating mode in which the grinding wheel approaches the base circle and reaches the base circle before the camshaft has rotated through an arc of 180°;

terminating said feed controlled operating mode when the grinding wheel reaches the base circle; and thereafter effecting a path controlled operating mode in which the grinding wheel remains on said circumferential cam profile to grind away all material on the blank outwardly of said cam profile.

4. The method of claim 3, wherein said feed controlled operating mode is carried out in a manner such that the grinding wheel reaches the base circle at a point thereon which is angularly offset from said point on the surface of the cam blank by an arc in the range of 20°–180°.

* * * * *